US007910864B2

(12) United States Patent
Bohlender

(10) Patent No.: US 7,910,864 B2
(45) Date of Patent: Mar. 22, 2011

(54) PTC HEATING ELEMENT

(75) Inventor: Franz Bohlender, Kandel (DE)

(73) Assignee: Catem GmbH & Co. KG, Herxheim Bei Landau (DE)

( * ) Notice: Subject to any disclaimer, the term of this patent is extended or adjusted under 35 U.S.C. 154(b) by 683 days.

(21) Appl. No.: 11/873,624

(22) Filed: Oct. 17, 2007

(65) Prior Publication Data

US 2008/0087660 A1 Apr. 17, 2008

(30) Foreign Application Priority Data

Oct. 17, 2006 (EP) ..... 06021777

(51) Int. Cl.
*H05B 3/10* (2006.01)
*F28D 7/00* (2006.01)

(52) U.S. Cl. ..... 219/553; 219/201; 219/202; 219/540; 219/541; 219/530; 219/552; 392/496; 392/485; 165/299; 165/300; 165/41; 165/172; 165/174; 165/176; 165/151; 165/148; 165/143

(58) Field of Classification Search ..... 219/201, 219/202, 540–1, 530, 552–3; 392/496, 485; 165/299, 300, 41, 172–6, 151, 148, 143
See application file for complete search history.

(56) References Cited

U.S. PATENT DOCUMENTS 3,720,807 A * 3/1973 Ting ..... 219/441

FOREIGN PATENT DOCUMENTS

EP 0350528 1/1990

* cited by examiner

*Primary Examiner* — Shawntina Fuqua
(74) *Attorney, Agent, or Firm* — Boyle Fredrickson, S.C.

(57) ABSTRACT

The present invention relates to a PTC heating element with at least one PTC resistance element which is arranged between two electrically conductive plates in a housing opening of a housing and, with at least one of the electrically conductive plates as an intermediate layer, which is pressed with an initial tension against a heat-emitting element which is held at the housing. With the present invention, a PTC heating element of the type mentioned at the beginning that can be manufactured easily and economically is to be specified. To solve this problem, the present invention further develops the PTC heating element mentioned at the beginning in such a way that attachment tabs arranged on the edge of the housing opening protrude beyond the housing opening and in such a way that the heat-emitting element has tab cuts, behind which the tabs engage.

13 Claims, 3 Drawing Sheets

PTC HEATING ELEMENT

BACKGROUND OF THE INVENTION

1. Field of the Invention

The present invention relates to a PTC heating element with at least one PTC resistance element that is arranged between two electrically conductive plates in a housing opening of a housing and that, with at least one of the electrically conductive plates as an intermediate layer, is pressed with an initial tension against a heat-emitting element that is held by the housing.

2. Description of the Related Art

Such a PTC heating element is known, for example, from EP 0 350 528, which is traced back to the applicant. In this state of the art, a number of PTC heating elements are arranged in a frame in a number of planes with heat-emitting elements, in the form of metal strips curved in a meandering manner, layered between. Located within the frame is a spring, which presses the two electrically conductive plates lying on the exterior of the PTC heating element against the PTC element for good thermal and electrical contacting and the heat-emitting elements against the adjacent electrically conductive plate for good heat transfer of the heat generated by the PTC resistance element. In the mentioned state of the art, the PTC heating element is used for heating air. There are, however, other embodiments also known in which the PTC resistance element heats a heating plate. Such embodiments are particularly known for heating or keeping warm foods, for example, baby food.

The problem forming the basis of the present invention is to specify a heating element of this category that can be manufactured simply and therefore economically.

To solve this problem, the present invention specifies a PTC heating element with the characteristics of Claim 1. This differs from the category-defining state of the art by a housing opening, whereby attachment tabs that are arranged around the edge of the housing opening protrude from it and whereby the heat-emitting element has tab cuts behind which the tabs engage when a heat-emitting element is mounted on the housing.

As a result of this engaging, the heat-emitting element is connected to the housing in a simple manner, for example, by being locked in place. Alternatively, the tabs can also have a thickening on their free end that engages behind the tab opening, whereby this thickening is formed by surface-fusing the respective tab. Such thickened tabs are achieved, for example, by hot stamping.

The tabs, however, serve more than just to attach the heat-generating element to the housing. Rather, the tabs encircle the housing opening and protrude from the exterior of the housing opening. In this way, the tabs form a guide that forms a guide of the housing in the insertion direction of the electrically conductive plates and the at least one PTC resistance element, as a result of which the assembly is simplified. In addition to this, the tabs can be formed with a funnel-shape on the upper free end, in order to facilitate simple insertion of the two strip conductors with the at least one PTC resistance element arranged between them.

OBJECT OF THE INVENTION

The tabs of the PTC heating element according to the invention accordingly take on a double function. On the one hand, because of their arrangement relative to the housing opening, they allow a simple, guided insertion of the electrically conductive plates together with the at least one PTC resistance element. Furthermore, they securely hold in position the heat-emitting element after the final assembly.

According to a preferred further development of the present invention, the tabs project beyond an upper contact surface for the heat-emitting element, whereby this contact surface is formed by the housing and is at a height that is dimensioned in such a way that the electrically conductive plate that is raised above the contact surface by the initial tension before the placement of the heat-emitting element does not extend higher than the upper end of the tabs. In this way, it becomes possible to fix in place during the assembly the layer composition that emits the heat and that is held in the housing opening. Preferably the tabs are dimensioned in such a way that the upper electrically conductive plate that is raised above the contact surface is roughly at the same height as the upper end of the tabs. With a view to the most sparing use possible of material for forming the housing and tabs, these should project beyond the upper electrically conductive plate only slightly in the raised position.

For further simplification of the PTC heating element, according to a preferred development of the present invention it is proposed that the electrically conductive plate lying opposite the heat-emitting element, i.e., that electrically conductive plate that is provided on the side other than the heat-emitting element with respect to the PTC resistance element, be provided with at least one spring element that is formed by means of stamping processing and by bending the sheet metal material that forms the electrically conductive plate as a single piece on this sheet metal material and that is supported on the housing. The spring element is preferably cut out from the sheet metal material that forms the electrically conductive plate in such a way that it initially projects beyond the outside of the contact surface of the at least one PTC resistance element at the corresponding electrically conductive plate. The projecting section is then preferably bent under the electrically conductive plate at the back of the contact surface, and it can be supported on the housing with this spring leg, whereby this housing is preferably closed on its underside lying opposite the housing opening. In the context of the present invention, a cut that opens towards the contact surface for the heat-emitting element is particularly understood as a housing opening, whereby the size of this cut roughly corresponds to the dimensions of the PTC resistance element(s) held in the housing. In other words, the housing opening, when seen from the top, has roughly the contour of the PTC resistance element(s) of the PTC heating element.

With a view to secure and simple localisation of plug sockets connected with cables to an electrical current source for the electrical connection of the PTC heating element, according to a further preferred development of the present invention it is proposed that the housing be given two plug holders, each of which has a locking opening for engaging with a snap-in pin formed on the plug socket, whereby a contact stud formed by stamping processing and bending the electrically conductive plate is arranged in the plug holder and consequently electrically connected in a permanent and simple manner to the plug socket undetachably secured in the housing by means of the locking connection.

For simple securing of the two electrically conductive plates in the housing, it has proven advantageous to guide each contact stud to the respective electrically conductive plate out of the housing through a contact stud cut that is cut outside the housing opening on the underside in a direction at right angles to the plane of the electrically conductive plate, and by deflection into the plug holder, to bring it into an alignment in which the contact stud runs essentially parallel to the electrically conductive plate and is inserted into the plug holder. In this further development, only that cut in the housing that serves to hold the PTC resistance element(s) is understood as the housing opening. Consequently, a housing opening formed with the area of a single PTC resistance element can, for example, be cut into the housing. The electrically conductive plates have a contact section lying on the PTC resistance element, whereby a connection section that has been punched free protrudes on its exterior circumferential surface. This connection section initially lies in the plane of the sheet metal strip that forms the electrically conductive plate. A sub-area of the connection section, i.e., the front end of the connection section forming the contact stud, is then bent by 90°, so that the contact stud essentially extends from the plane of the sheet metal material at a right angle. In this state, the electrically conductive plate, with its contact section, is introduced into the opening of the housing. The contact stud here penetrates the contact stud cut that is cut into the underside of the housing and protrudes beyond the housing from the exterior. Subsequently, the protruding section is reshaped, for example, by a slide, and introduced into the contact stud holder that runs essentially parallel to the contact surface of the contact section, i.e., parallel to the bearing surface for the heat-emitting element. After this reshaping step, the respective strip conductor is held securely in the housing. The connection section of the electrically conductive plate is preferably surrounded relatively tightly by walls of the housing for this, and consequently held in a fixed position in the housing.

Further advantages and details of the present invention result from the following description, in conjunction with the drawing. This drawing shows:

DETAILED DESCRIPTION OF THE PREFERRED EMBODIMENT

Figure 1:
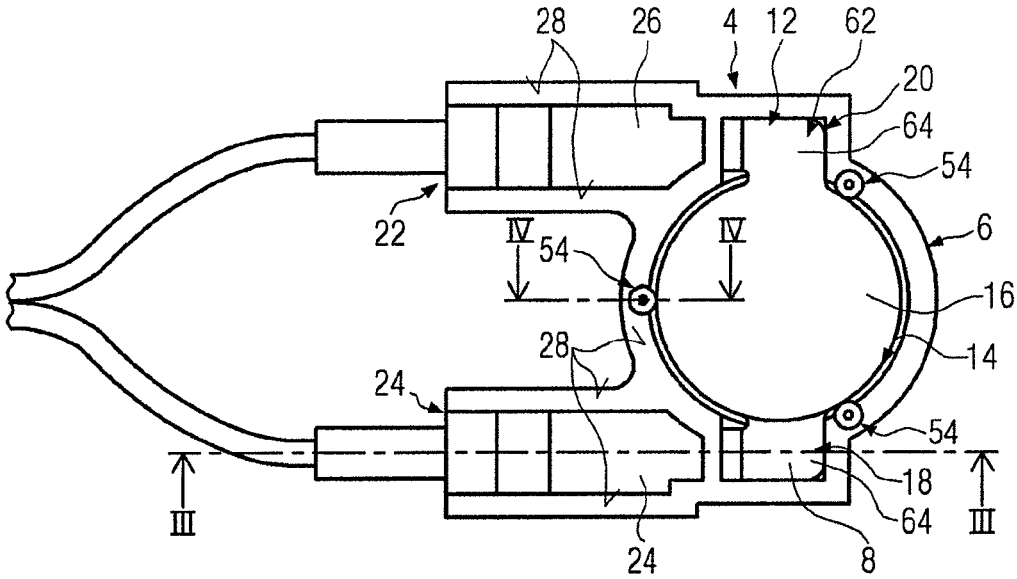
FIG. 1 a top view of the upper side of an embodiment of a PTC heating element with the heating plate removed.

The embodiment depicted in the drawing is a PTC heating element for heating baby food or keeping it warm, and this PTC heating element is held inside an injection moulded housing (not shown) which forms the holder for the container holding the baby food (bottle, jar). The PTC heating element shown in the drawing is located in the base of this injection moulded housing. This, with its heating plate 2, forms the support for the container that holds the baby food and that stands directly on the heating plate 2.

The embodiment shown in the drawing has a housing 4, which essentially consists of three separated segments. Consequently, the housing 4 has a holder section 6 for holding a heat-emitting layer composition comprising a lower electrically conductive plate 8, a PTC heating element 10 arranged in between with an essentially circular shape and an upper electrically conductive plate 12 (cf. FIG. 3). For holding this layer composition, the holder section 6 has an essentially round opening 14 that is only slightly larger than the layer composition. In this layer composition, the lower electrically conductive plate 8 and the upper electrically conductive plate 12 each have a round contact section 16 formed according to the contour of the round PTC element.

On opposite sides, electrically conductive plate receiving chambers 18, 20 are provided that fork off through the housing 4 from the opening 14 and that open towards the opening 14, whereby the bases of these can be raised slightly with respect to the base of the opening 14.

The housing 4 forms two plug holders 22, 24, in addition to the holder section 6. These plug holders 22, 24 are covered with respect to the upper side of the PTC heating element shown in FIG. 1 by a covering 26 that is located below a contact surface 28 for the heating plate 2, whereby this contact surface 28 is formed by the upper side of the housing 4. This contact surface 28 runs essentially across the entire contour of the housing 4 along the edge.

Each of the plug holders 22, 24 is formed for holding one plug socket 30. The plug socket 30 essentially has a rectangular cross-section with flat upper and undersides 32, 33, as well as a snap-in pin 34 that projects from the upper side 32 (cf. FIG. 3). Corresponding to this, each of the plug holders 22 and 24 has a locking opening 36 that is cut into the interior side of the covering 24 or 26 in the shown embodiment, without penetrating the respective covering 24, 26.

Figure 3:
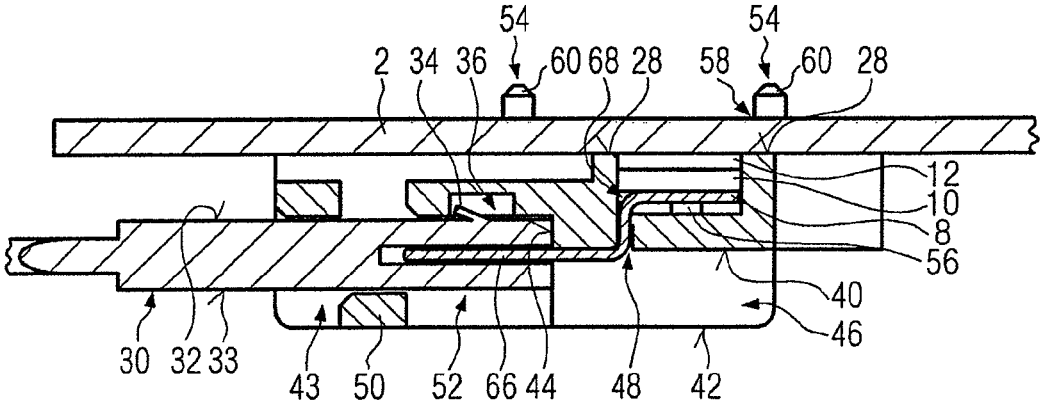
FIG. 3 a longitudinal sectional view along the line III-III according to the depiction in FIG. 1 with the heating plate positioned.

As the section view according to FIG. 3 shows, the exterior base 40 of the plate receiving chambers 18, 20 is at the same height as the underside 42 of the housing 4. In extension of the edges of the plug holder 22, 24, contact bars 43 form the underside 42 of the housing 2. Between the base 40 and the underside of the covering 24, 26, the housing 4 forms a limit stop 44 for the plug socket 30. Below this limit stop 44, the cut that is formed by the plug holder 22, 24 and that is on the underside of the housing 2 is penetrated up to the back end of the same. In other words, the plug holder 22 or 24 continues beyond the cut 46 and until the rear end of the housing 4. A contact stud holder 48 that, as a slot, connects the base 40, exposed at the bottom, of the housing to the interior of the holder section 40, opens towards the cut 46, and is provided outside the opening 14 and in extension of the plug holders 22, 24.

Figure 2:
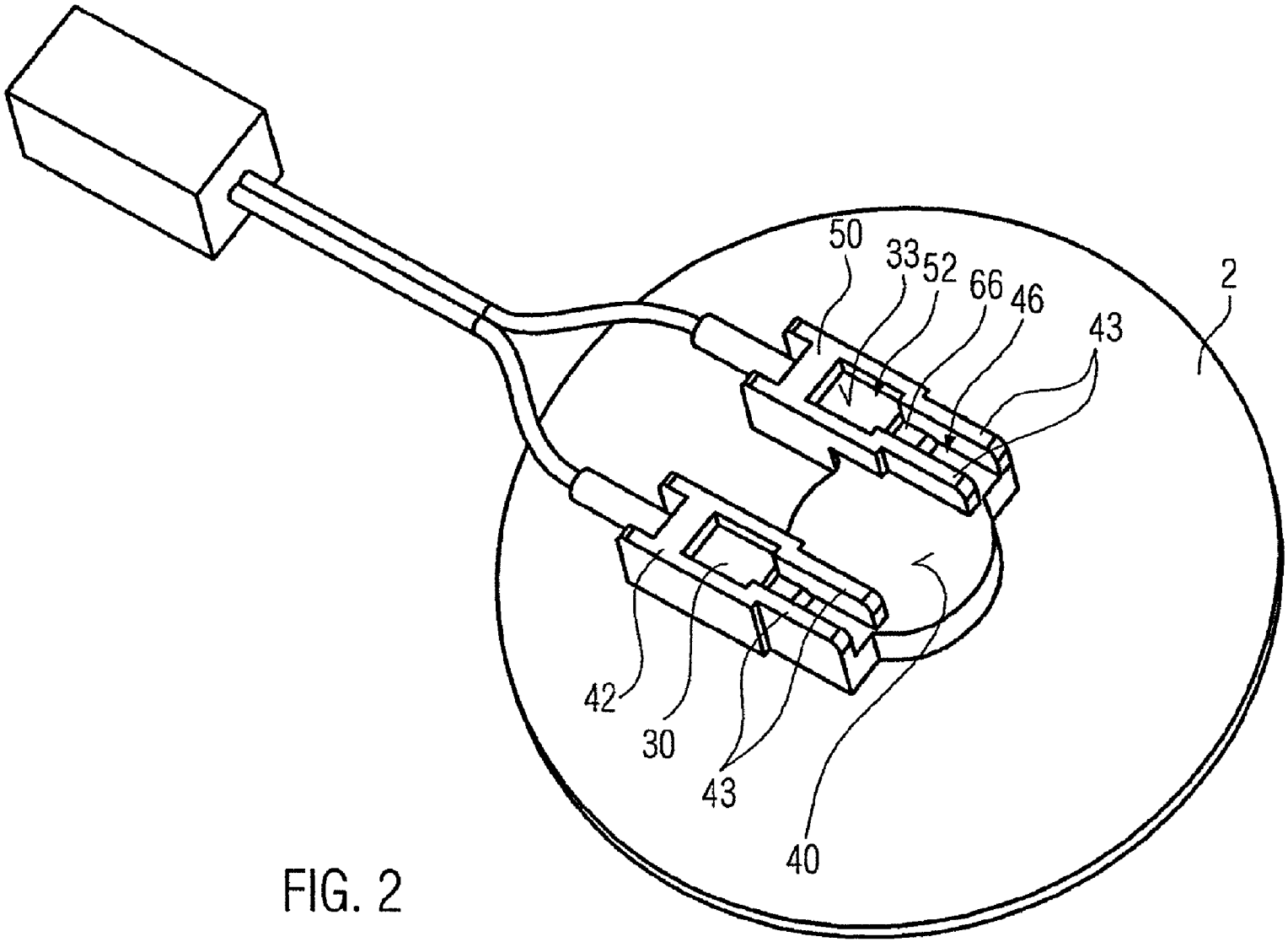
FIG. 2 a perspective top view of the underside of the embodiment shown in FIG. 1.

The plug holders 22, 24 are bordered on the bottom by a partition wall 50 that is provided in the front area of the plug holder 22 or 24 in the insertion direction of the plug socket 30 and that connects the two contact bars 43 of the respective plug holders 22, 24. Behind this, in the insertion direction, each of the plug holders 22, 24 has a contact stud insertion opening 52 that, for reasons of injection moulding manufacture of the housing 4, is formed with the width of the plug holder 22 or 24 (cf. FIG. 2).

As can be seen in FIG. 1, three tabs 54 project beyond the contact surface 28, whereby these three tabs 54 are provided on the edge of the round interior circumferential area of the opening 14. The tabs 54 can be provided as a single piece with the housing 4 by means of injection moulding.

Alternatively, when the housing 4 is manufactured by injection moulding, tab cuts can be cut out and the tabs 54 can be inserted into these. In this development, it is, for example, possible to form the tabs with protruding springs on their underside ends, whereby these protruding springs are supported in the interior on the base of the housing opening 14 and press against the lower electrically conductive plate 8, in order to press it, together with the PTC resistance element 10 and the upper electrically conductive plate 12, against the heating plate 2 after assembly.

In an alternative development, which is realised in the shown embodiment, the lower electrically conductive plate 8 has protruding springs 56 formed in a single piece with it (cf.

Figure 4:
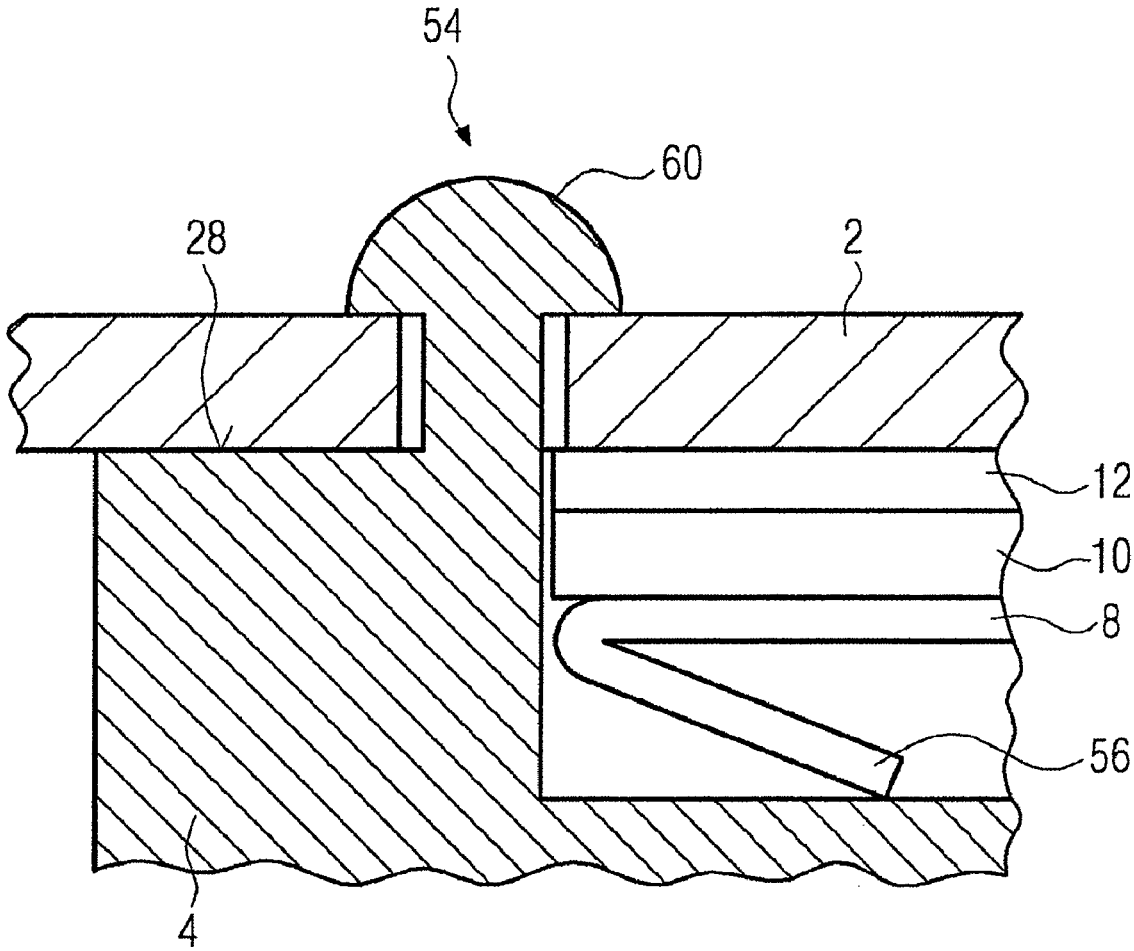
FIG. 4 a longitudinal sectional view along the line IV-IV according to the depiction in FIG. 1 with the heating plate positioned.

FIG. 4). These protruding springs 56 are initially formed by cutting free the sheet metal material forming the lower electrically conductive plate 8 and, in a following manufacturing step, bending them under the underside of the lower electrically conductive plate 8, so that protruding springs 56 provided on the interior of the base 40 in a single piece with the lower electrically conductive plate 8 are formed. Preferably, a number of protruding springs 56 are provided on the circumference of the round contact section 16 and from there guided under the lower electrically conductive plate 8.

The tabs 54 project beyond the contact surface 28 with a height that depends on two factors: firstly, the tabs serve to hold the pre-mounted layer composition. Due to the force of the protruding springs 56, the layer composition is pressed against the interior side of the heating plate 2 after the assembly, for good heat transfer to the heating plate 2. This means that before the final assembly, i.e., before the attachment of the heating plate 2 to the housing 4, the layer composition protrudes beyond the contact surface 28. The tabs 54 provided around the opening 14 and distributed around the circumference here ensure that the upper electrically conductive plate 12 remains within the circumferential surface of the opening 14, even in this raised position.

Furthermore, the heating plate 2 has tab cuts 58 corresponding to the tabs 54, whereby these tabs 54 engage behind these tab cuts 58 after the heating plate 2 is positioned on the contact surface 28. For this purpose, the tabs 54 can have snap-in projections that engage behind the tab cuts 58. In the embodiment shown, the tabs 54 are formed with a thickening 60 by means of hot stamping after the assembly of the heating plate 2, whereby this thickening 60 protrudes beyond the tab cut 58. Accordingly, the housing 4 and the heating plate 2 are undetachably connected to each other by means of the thickenings 60 of the tabs 54.

For the electrical connection of the lower and upper electrically conductive plates 8, 12, these have connection sections 62 that go off from the contact sections 16 at opposite sides. Each connection section 62 can be subdivided into a contact stud base 64, which is cut out by means of stamping processing and which runs in a radial direction with respect to the contact section 16, and a contact stud 66, which runs perpendicular thereto. The contact stud base 64 lies within the electrically conductive plate chambers 18 or 20; the contact stud 66 is electrically connected to the plug socket 30.

For assembly, first the contact stud 66 is bent out of the plane of the sheet metal material at the transition to the contact stud base 64 by 90°. A fold 68 formed in this way is dimensioned in such a way that it lies in an extension of the slot-shaped contact stud holder 48 when the electrically conductive plate 8, 12 is introduced into the opening 14. During the assembly, i.e., during the insertion of the layer composition into the opening 14, the contact studs 66 are accordingly inserted through the contact stud holders 48. Subsequently, the linear section of the contact studs 66 that protrudes beyond the base 40 is turned by 90° on to the respective plug holder 22 or 24 by a slide, so that the front end of the contact stud 66 is deviated through the contact stud insertion opening 52 and into the plug holder 20, 24. This reshaping step normally takes place after the heating plate 2 has been attached to the housing 4 and consequently the layer composition is held in the opening 14 with respect to the height due to the initial tension of the protruding springs 56. In this case, the contact stud 66 can be positioned between the contact stud holder 48 and the limit stop 44, essentially against the base 40, without there being any grounds for fearing the loss of the desired good heat transfer due to a flat fit of the upper electrically conductive plate 12 and the underside of the heating plate 2. After the bending of the contact stud 66, this then runs essentially parallel to the upper or underside 42 of the housing 4, is essentially held in place with respect to the height by the base 40 and, due to the guide within the contact stud holder 48, is fixed in place across the width within certain limits and secured in such a way that the plug socket 20 can be slid on to the contact stud 66 and consequently electrically contacted, without it being possible for the contact stud 66 to avoid the frictional forces acting here.

The invention claimed is:

1. A PTC heating element comprising:

at least one PTC resistance element that is arranged between two electrically conductive plates in a housing opening of a housing and that lies with initial tension against a heat-emitting element with at least one of the electrically conductive plates as an intermediate layer, wherein said heat-emitting element is held at the housing, wherein attachment tabs, arranged on the edge of the housing opening, protrude beyond the housing opening, and wherein the heat-emitting element has tab cuts with the tabs engaging behind them.

2. A PTC heating element comprising:

at least one PTC resistance element that is arranged between two electrically conductive plates in a housing opening of a housing and that lies with initial tension against a heat-emitting element with at least one of the electrically conductive plates as an intermediate layer, wherein said heat-emitting element is held at the housing, wherein attachment tabs, arranged on the edge of the housing opening, protrude beyond the housing opening, and wherein the heat-emitting element has tab cuts with the tabs engaging behind them, wherein the tabs project beyond an upper contact surface for the heat-emitting element at a height that is dimensioned in such a way that the electrically conductive plate that is raised above the contact surface by the initial tension before the placement of the heat-emitting element onto the contact surface does not extend higher than the upper end of the tabs.

3. The PTC heating element according to claim 2, wherein the tabs have snap-in pins on the ends that engage with the assigned tab cut.

4. The PTC heating element according to claim 2, wherein the free end of the tabs has a thickening on the end that engages behind the tab cut, and wherein this thickening is formed via surface-fusing the tab.

5. The PTC heating element according to claim 1, wherein the electrically conductive plate lying opposite the heat-emitting element has at least one spring element formed as a single piece on it via stamping processing and bending, and wherein the spring element is supported on the housing.

6. The PTC heating element according to claim 5, wherein the housing opening is closed on the underside lying opposite the heat-emitting element.

7. A PTC heating element comprising:

at least one PTC resistance element that is arranged between two electrically conductive plates in a housing opening of a housing and that lies with initial tension against a heat-emitting element with at least one of the electrically conductive plates as an intermediate layer, wherein said heat-emitting element is held at the housing, wherein attachment tabs, arranged on the edge of the housing opening, protrude beyond the housing opening, and wherein the heat-emitting element has tab cuts with the tabs engaging behind them, and wherein the electrically conductive plate lying opposite the heat-emitting element has at least one spring element formed as a single piece on it via stamping processing and bending, and wherein the spring element is supported on the housing, and wherein the tabs project beyond an upper contact surface for the heat-emitting element at a height that is dimensioned in such a way that the electrically conductive plate that is raised above the contact surface by the initial tension before the placement of the heat-emitting element on to the contact surface does not extend higher than the upper end of the tabs.

8. The PTC heating element according to claim 7, wherein the tabs have snap-in pins on the ends that engage with the assigned tab cut.

9. The PTC heating element according to claim 7, wherein the free end of the tabs has a thickening on the end that engages behind the tab cut, wherein this thickening is formed by means of surface-fusing the tab.

10. The PTC heating element according to claim 1, wherein the housing forms two plug holders, each of which has a locking opening for engaging with a snap-in pin formed from a plug socket, and wherein a contact stud, formed by stamping processing and bending of the electrically conductive plate, is arranged in the plug holder.

11. The PTC heating element according to claim 10, wherein the contact stud is guided out of the housing through a contact stud holder cut on the underside outside the housing opening in a direction essentially at right angles to the plane of the electrically conductive plate and is introduced into the plug holder by deviated into the plug holder in a direction running essentially parallel to the plane of the electrically conductive plate.

12. The PTC heating element according to claim 11, wherein the housing has an opening in an extension of the contact stud holder that projects into the interior of the housing, wherein the contact stud lies exposed towards the underside of the housing in this opening.

13. The PTC heating element according to claim 1, wherein the conductive plates are made of sheet metal material.

* * * * *